United States Patent [19]

Nelson

[11] Patent Number: 5,012,894

[45] Date of Patent: May 7, 1991

[54] SCAFFOLD ERECTION STRUCTURE

[76] Inventor: Kurt A. Nelson, P.O. Box 272, Batavia, Ill. 60510

[21] Appl. No.: 557,328

[22] Filed: Jul. 23, 1990

[51] Int. Cl.[5] ..... E04G 1/06; E04G 1/15

[52] U.S. Cl. ..... 182/178; 182/63; 182/179

[58] Field of Search ..... 182/178, 179, 63

[56] References Cited

U.S. PATENT DOCUMENTS

| | | | |
|---|---|---|---|
| 3,221,838 | 12/1965 | Brayton | 182/178 |
| 3,250,401 | 5/1966 | Davidson | 182/178 |
| 3,479,010 | 11/1969 | Harmon | 182/178 |
| 3,504,461 | 4/1970 | Copeland | 182/178 |
| 3,614,993 | 10/1971 | Penso | 182/178 |
| 3,684,056 | 8/1972 | Penso | 182/178 |
| 3,878,916 | 4/1975 | White | 182/178 |
| 3,915,303 | 10/1975 | Tatham | 182/178 |

*Primary Examiner*—Reinaldo P. Machado
*Attorney, Agent, or Firm*—John L. Schmitt

[57] ABSTRACT

A structure particularly adapted for erecting construction site scaffolding comprises an elongated lower frame pivotally joined to an upper frame. The lower frame is formed with a pair of radiused guide rails which interact with slide brackets of the upper frame when the lower frame is rotated above the pivot connection. The upper frame further includes two sets of spaced apart tube sections prepared to receive tongs of a forklift-type truck. The lower frame in turn has a series of downward extending, spaced apart retaining brackets. To erect a section of scaffold the erection structure first is raised by the forklift truck to allow upper cross pieces of scaffold end frame units to be secured in the lower frame retaining brackets. While these end frame units are hanging freely downward, they are joined together by crossing bracing to form a self-supporting first setional tier of the scaffold. A second sectional tier may be added by further raising the erection structure. Upper ends of further scaffold end frame units next are connected to lower ends of the end frame units of the first sectional tier. Further cross bracing then is connected to complete the second sectional tier.

12 Claims, 3 Drawing Sheets

SCAFFOLD ERECTION STRUCTURE

BACKGROUND OF THE INVENTION

1. Field of the Invention

This invention relates to support structures and more particularly to a structure for erecting sections of scaffolding at a construction site and relocation of the completed scaffolding as required.

2. Prior Art

Scaffolding allowing work to be performed at elevated heights has been used for many centuries. For example, in the early 1500's Michelangelo painted the ceiling of the Sistine Chapel while allegedly supported by scaffolding.

In modern times scaffolding typically is formed by joining a series of scaffold sections together. Each section comprises a pair of spaced apart end frame units made from integrally joined tubular members. The end frame units then are connected by cross bracing having a tubular or bar form. Connection between such promote ready assembly and disassembly.

When disassembled, the end frame units and cross bracing may be loaded onto a truck and moved to another location for reuse. U.S. Pat. No. 3,915,303 discloses apparatus for tying together a series of scaffold end frame units. The apparatus and included end frame units then may be handled and moved more easily.

A length of the scaffold may be increased by merely connecting additional horizontally positioned sections. Two adjoining sections share a common end frame unit. Wooden planks placed on upper cross pieces of the end frame units form an elevated work platform.

A height of the work platform may be increased by adding further sectional tiers progressively on top of the lower sectional tiers. These tiers, interconnected with ladders, allow workmen to ascent to heights several hundred feet above ground level. U.S. Pat. Nos. 2,379,446 and 2,555,782 disclose typical forms of scaffold structure.

An a typical scaffold is set out in U.S. Pat. No. 2,598,730. This structure has a C-like shape defined by spaced apart upper and lower horizontal portions connected by an upright section. The structure is portable allowing its selective movement by a forklift truck under an upper deck of a pier. The truck first lifts the structure and then moves it to a position beyond an edge of the pier. Next, the truck lowers the structure until the lower horizontal portion is below the pier upper deck. Lastly, the truck moves in a reverse direction to position the lower portion under the deck. This lower portion then forms a work platform.

SUMMARY OF THE INVENTION

Scaffold erection structure of this invention includes an upper frame portion pivotally connected to a lower frame portion. To maintain alignment between these frame portions during any rotation, the upper frame portion has a pair of downward extending slide brackets that fit about a pair of semicircular guide rails of the lower frame portion. A locking mechanism prevents rotation of the lower frame portion except as required.

The upper frame portion further includes a pair of spaced tube sections to receive lifting tongs of a forklift truck. The lower frame portion in turn has sets of spaced apart retaining brackets prepared to receive top cross bars of two or three scaffold end frame units.

To use the erection structure a forklift truck is moved so as to insert its lifting tongs into the tube sections of the upper frame portion. The truck then raises the structure above six feet allowing a worker to secure the top cross piece of three scaffold end frame units, for example, in the retaining brackets of the lower frame portion. The elevated height of the erection structure is such that a bottom of each scaffold end frame unit is clear of the ground supporting the truck.

As the scaffold end frame units are hanging vertically downward from the erection structure, the three end frame units are connected by cross bracing to form two sections of scaffold. If another sectional tier of scaffold is required to increase the height of the scaffold work platform, the truck raises the now completed scaffold sectional tier. Another sectional tier then is connected to a bottom of the first or upper sectional tier.

Note that the scaffold may be erected at a location which is remote from the place where the scaffolding is to be used. In this case the forklift merely moves the completed scaffolding from the point of erection to the point of use, for example next to a wall of a building under construction.

The scaffold erection structure of this invention provides several advantages.

A first advantage is that sections of scaffold may be erected by just one workman. One worker may connect the cross bracing to the upright positioned end frame units. Theretofore, a first worker typically was required to hold the end frame units while a second worker attached the crossing bracing.

A second provided advantage is that all the scaffold sections may be erected safely at ground level and at a location suited for that erection. Use of the erection structure allows the height of the scaffold work platform to be increased by adding sections from below. There is no need to elevate the various scaffold section components for attachment to tops of the sections forming the uppermost sectional tier.

A still further advantage is that during movement of completed scaffold sections by the forklift truck, the lock mechanism of the erection structure prevents any rotation of the lower frame portion with respect to the upper frame portion and the truck. Any such rotation during this movement could produce an unwanted unbalancing. As the truck approaches the place where the scaffold sections are to be used, the lower frame portion may be unlocked allowing the lower frame portion and supported scaffold sections to be swung into alignment with a wall of a building, for example. Thus, the truck need not approach this wall exactly perpendicular. Since ground at a construction site typically is ungraded, the truck carrying the scaffold sections may take a route most easily and safely traversed.

DESCRIPTION OF THE PREFERRED EMBODIMENT

Figure 1:
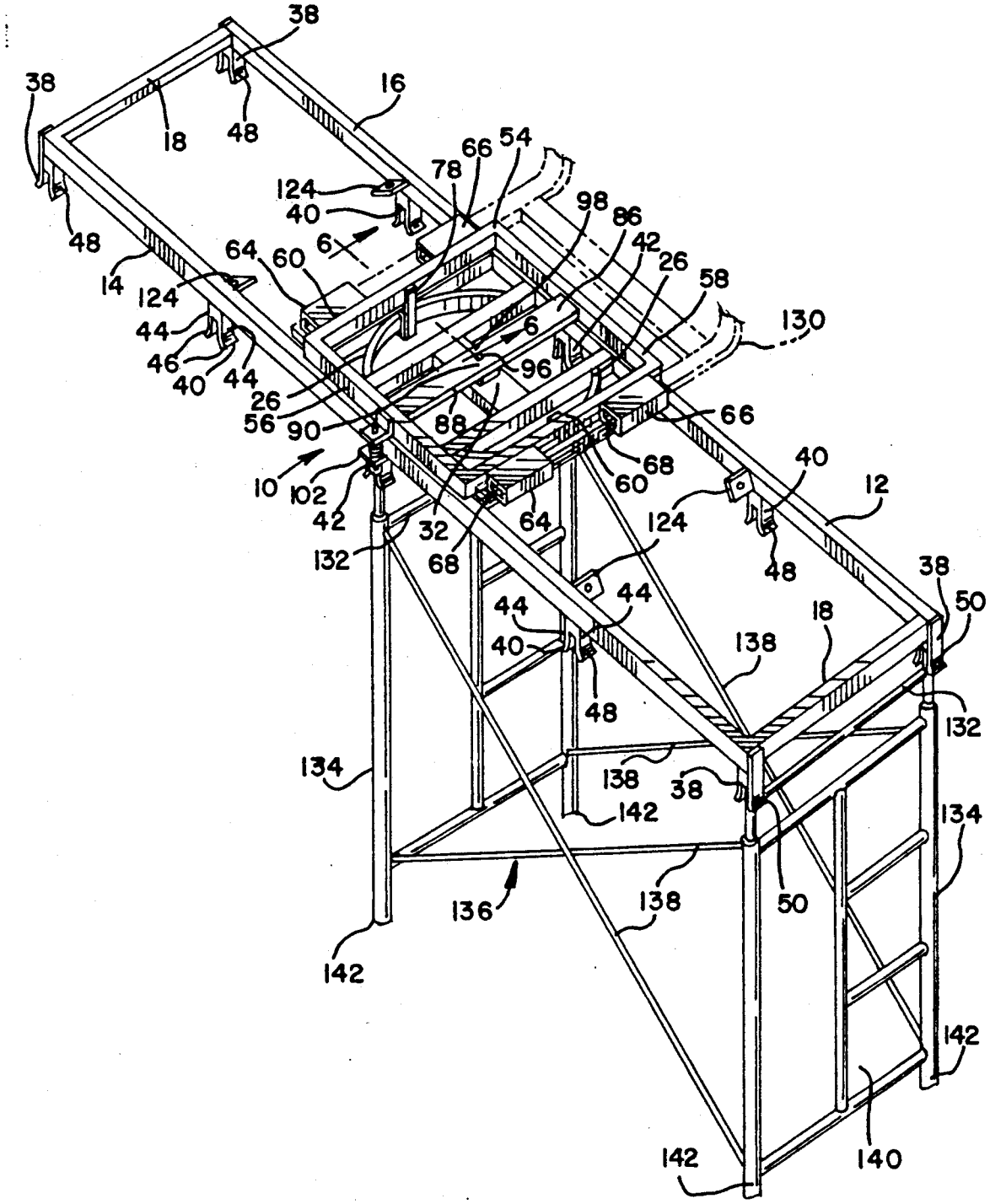
FIG. 1 is a perspective view of a scaffold erection structure of this invention being carried by tongs of a forklift truck. The erection structure in turn is carrying a section of scaffold.
Figure 2:
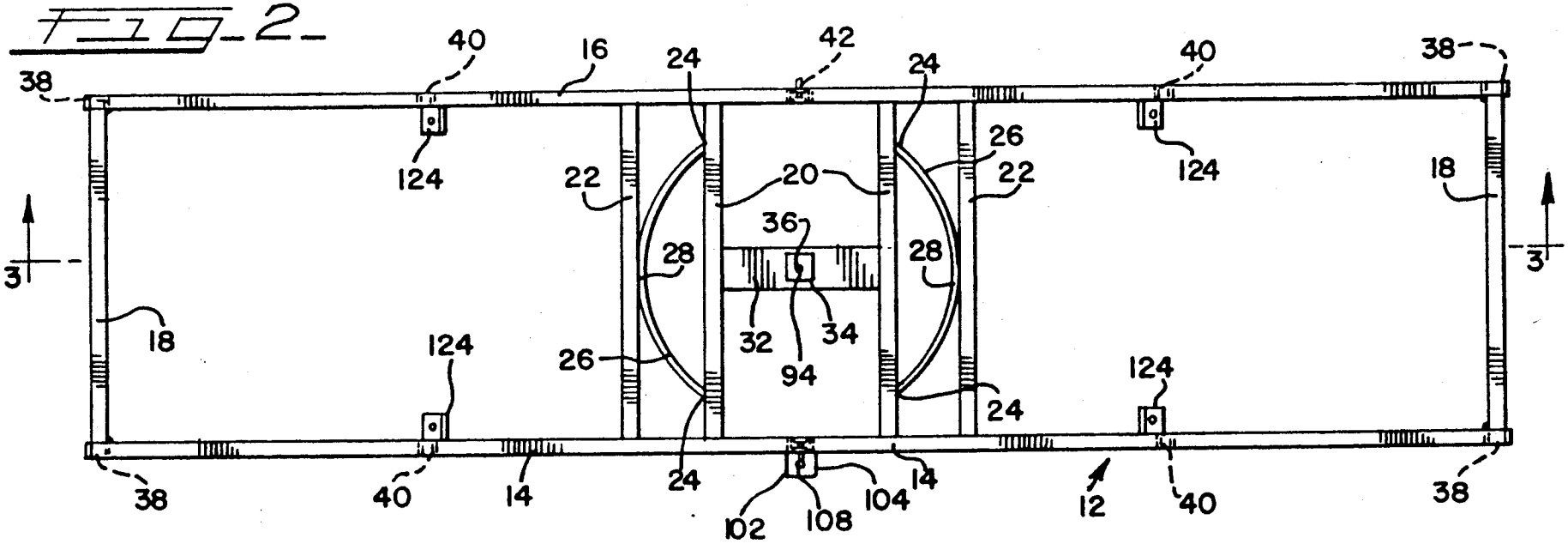
FIG. 2 is a plan view of a lower frame portion of the erection structure.

An erection structure of this invention is shown generally in FIG. 1 and designated 10. The structure 10 comprises a lower frame portion 12 shown in detail in FIGS. 2 and 3. The lower frame portion 12 is rectangular in shape and defined by spaced apart, elongated front and rear members 14, 16 which are connected by end members 18. These members 14–18 preferably have a tubular cross sectional configuration.

Figure 6:
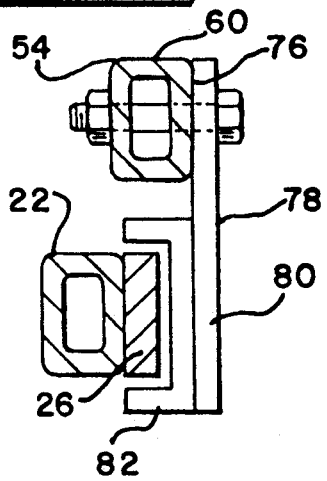
FIG. 6 is a cross section view as seen generally along the line 6—6 of FIG. 1 showing in detail a slide bracket of the upper frame portion engaging a portion of a guide rail of the lower frame portion.

Positioned between the front and rear members 14, 16 near and on respective sides of a center of the lower frame portion 12 is a pair of inner cross braces 20 and outer cross braces 22. Respective ends 24 of a pair of radiused shaped guides rails 26 then are attached to the inner cross braces 20. A center section 28 of each guide rail 26 in turn is connected a middle part of the adjacent outer cross brace 22. As seen typically in FIG. 6, the guide rail 26 has a bar-like shape.

Figure 3:
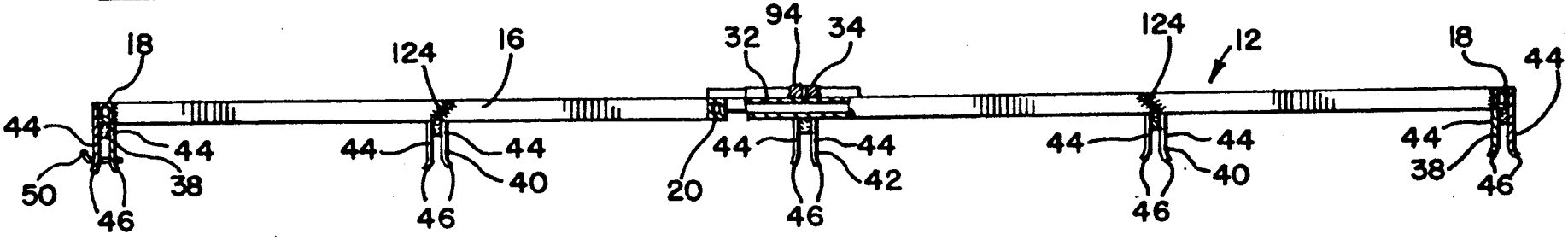
FIG. 3 is a partial cross section view of the lower frame portion as seen generally along the line 3—3 of FIG. 2.

Extending longitudinally between the inner cross braces 20 is a pivot support bar 32. On this pivot support bar 32 is a bearing plate 34 formed with an aperture 36. Attached to and extending downward from the front and rear members 14, 16 are two sets of end retaining brackets 38, two sets of intermediate retaining brackets 40, and a set of center retaining brackets 42. Each bracket 38–42 comprises a pairs of spaced apart plates 44 formed with flared out ends 46. In the flared ends 46 of each bracket plate pair 44 are aligned openings 48 for a retaining pin 50. One such pin 50 is shown in FIG. 3.

Figure 4:
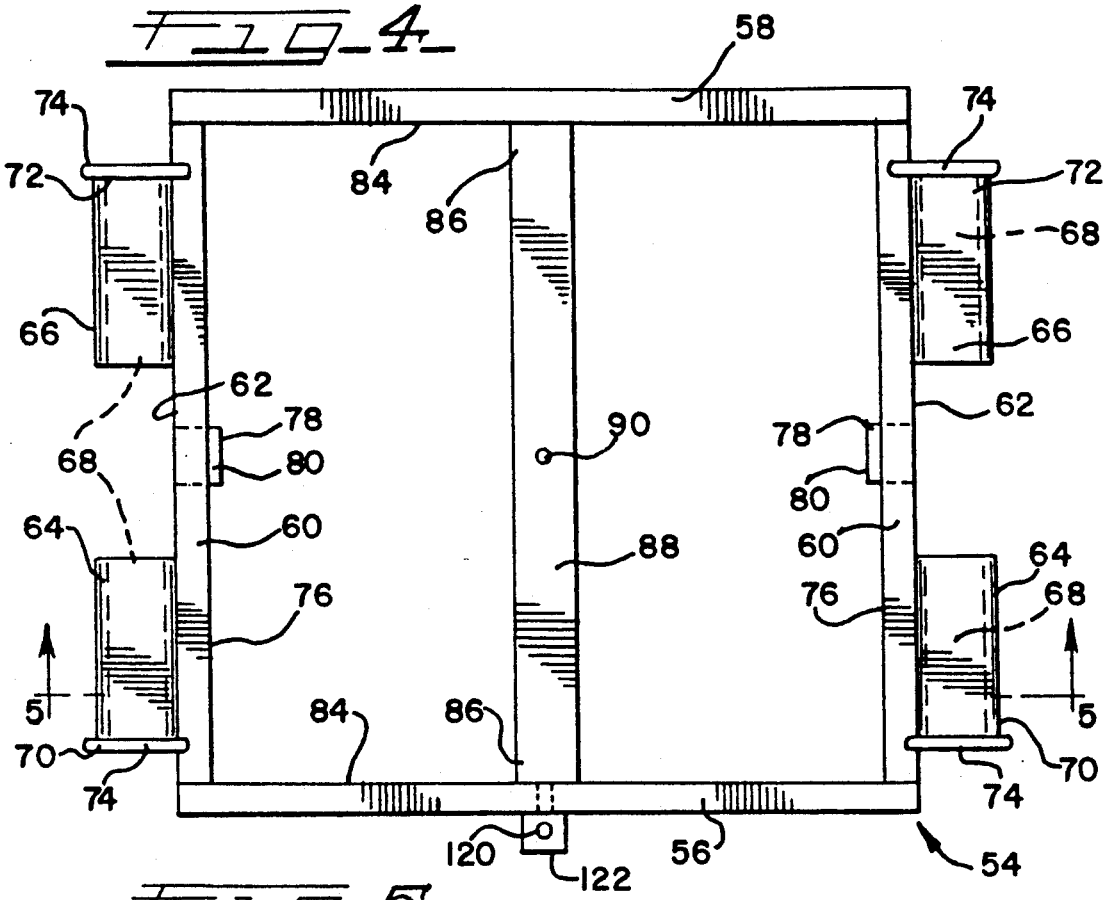
FIG. 4 is a plan view of an upper frame portion of the erection structure.
Figure 5:
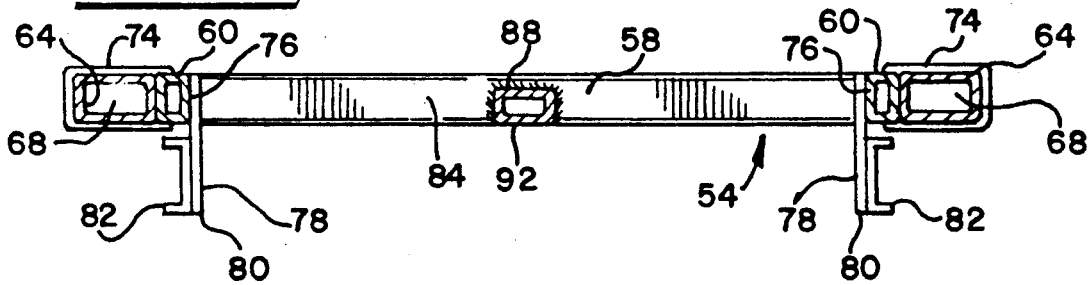
FIG. 5 is a cross section view of the upper frame portion as seen generally along the line 5—5 of FIG. 4.

The scaffold erection structure 10 further includes an upper frame portion 54. The upper frame portion 54 has a square-like shape and is shown in detail in FIGS. 4 and 5. Like the lower frame portion 10 the upper frame portion 54 comprises spaced apart front and rear members 56, 58 connected by end members 60. Again, the members 56–60 preferably have a tubular cross sectional configuration. Attached to an outer side 62 of each end member 60 is a pair of spaced apart, front and rear tube sections 64, 66. The sections 64, 66 of each pair are positioned to provide a set of aligned inner passageways 68. Reinforcing a front end 70 of each front tube section 64 and a rear end 72 of each rear tube section 66 is a U-shaped bracket 74.

Attached to an inner side 76 of each upper frame portion end member 60 at a midpoint of such is a slide bracket 78. Each slide bracket 78 comprises a downward extending plate 80 to which is attached an outward facing slide element 82. Each slide element 82 has a channel-like cross sectional configuration, see FIGS. 5 and 6. Attached to an inner side 84 of the upper frame portion front and rear members 56, 58 at a midpoint of each are ends 86 of a pivot member 88. In a center of this pivot member 88 is an aperture 90.

When the upper frame portion 54 is assembled to the lower frame portion 12, a bottom side 92 of the pivot member 88 rests on upper surface 94 of the lower frame portion bearing plate 34. With the apertures 36, 90 aligned, a pivot pin 96 may be inserted through the apertures 36, 90 and secured therein to form a pivot connection 98. Additionally, the slide elements 82 of the upper frame portion slide brackets 78 are positioned respectively about the guide rails 26 of the lower frame portion 12. A length of each guide rail 26 is such that the lower frame portion 12 may rotate about 100 degrees about the pivot connection 98.

Figure 7:
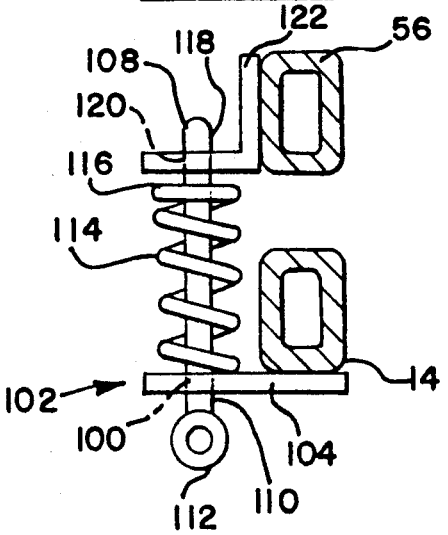
FIG. 7 is a side elevation view partially in section showing a locking mechanism of the erection structure.

To allow only selective rotation of the lower frame portion 12, the erection structure 10 includes a locking mechanism 102, see FIG. 7. This mechanism 102 comprises a lock plate 104 attached to and extending outward from the lower frame portion front member 14. The lock plate 104 is formed with an end opening 100 for a locking pin 108. A bottom end 110 of the locking pin 108 includes an eyelet fitting 112. The pin 108 is held in a vertical, releasable position by a coil spring 114. The coil spring 114 is positioned about the pin 108 and compressively held by a collar 116 carried by the pin 108. An upper end 118 of the locking pin 108 locates in an opening 120 in a latch bracket 122 attached to and extending outward from the upper frame portion front member 56.

To use the scaffold erection structure 10 tongs 130, shown by broken lines in FIG. 1, of a forklift truck (not shown) are inserted into the inner passageways 68 of the upper frame portion tube sections 64, 66. It should be understood that the terms "front" and "rear" are used only for purposes of convenience. The structure 10 has no defined front or rear. The forklift tongs 130 may be inserted into the tube section passageways 68 from either side of the structure 10.

The erection structure 10 is raised by the forklift truck a distance slight greater than the height of a typical scaffold end frame unit, for example six feet. As seen in FIG. 1, upper cross pieces 132 of two such end frame units 134 have been positioned respectively between the plates 44 of one set the end brackets 38 and the plates 44 of the center brackets 42. The end frame units 134 then are secured in place by the pins 50 inserted through the aligned apertures 48 in the brackets 38, 42.

The end brackets 38 are located seven feet on each side of the center brackets 42. The end and center brackets 38, 42 are used to erect two scaffold sections. For purposes of simplification, FIG. 1 shows only one such scaffold section 136 having been completed. This scaffold section 136 includes two end frame units 134 connected by a series of cross bracing bars 138. If only one scaffold section 136 were to be erected, the upper cross pieces 132 of the end frame units 134 would have been secured in the intermediate brackets 40, also spaced seven feet apart. In either case, the erected scaffold section or sections 134 create one sectional tier 140 that is equispaced on each side and therefore substantially balanced with respect to the pivot connection 98 of the erection structure 10.

If another sectional tier 140 were required to raise the working height of the first sectional tier 140 further above the ground, the forklift is activated to raise the erection structure 10 an additional six feet. Further sections 136 of scaffold then may be joined to bottom ends 142 of the end frame units 134 of the first sectional tier 140. When a forklift truck is used, only three such sectional tiers 140 may be erected to provide a working height of about 18 feet above the ground.

When more than three sectional tiers 140 are required, the erection structure 10 is attached to a crane (not shown). The lower frame portion 12 of the structure 10 includes two sets of angularly positioned sling clips 124. These clips 124 allow the erection structure 10 to be connected by a sling (not shown) to a boom of the crane. The structure 10 then may be raised in increments to add successive sectional tiers 140. By using a crane, scaffolding may be erected having a work platform of its uppermost sectional tier 140 several hundred feet above ground level. Note that the point of erection, whether using a forklift or a crane, may be at a location which is remote from the location where the scaffolds sections 136 are to be used.

As seen in FIG. 1 and assuming that only one sectional tier 140 of scaffolding is required and that an additional section 136 has been joined to the section 136 shown, the forklift may move the sections 136 from the point of erection to the point of use. During such movement the frame portions 12, 54 are secured in place by the locking mechanism 102. Since the forklift may have to travel over rough terrain, any rotational movement of the lower frame portion 12 could produce an injurious unbalancing effect. Independent rocking of the lower frame portion 12, which would add to any unbalancing, is inhibited by interference between the upper frame portion slide brackets 78 and the lower frame portion guide rails 26.

When the truck is close to the point where the scaffold sections 136 are to be used, for instance a wall of a building under construction, a rope (not shown) attached the eyelet fitting 112 of the locking mechanism pin 108 may be pulled downward to release the lower frame portion 12 from the upper frame portion 54. The lower frame portion 12 and the supported scaffold sections 136 then may be swung to a position where they align with the building wall.

During this rotation interaction between the slide brackets 78 and the guide rails 26 prevents any load imbalance from over stressing the pivot connection 98. The truck then may move forward to place the scaffold sections 136 next to the building. These sections 136 then are released from the structure 10 by removing the pins 50. As required, the erection frame 10 may be reattached to the scaffold sections 136, and these section 136 moved to a different location for use without disassembly.

While an embodiment, uses, and advantages of this invention have been shown and described, it should be understood that this invention is limited only by the claims. Those skilled in the art will appreciate that various modifications or changes may be made without departing from the scope and spirit of the invention, and any such modification or change may result in further uses and advantages.

What I claim is:

1. A device particularly adapted for erecting sections of scaffolding, said device comprising:

a structure having an upper frame portion carrying a lower frame portion, lifting means carried by said structure to allow selective raising and lowering of said structure by external power means, and bracket means connected to said lower frame portion for selective securement of end frame units of said scaffolding, wherein said structure may be operatively engaged by said power means to raise said structure above a supporting surface thereunder, said scaffold end frame units may be secured in said bracket means to hang vertically therebelow in a spaced apart relationship, and said end frame units may be connected by cross bracing to form said sections of said scaffolding.

2. A device as defined by claim 1 and further characterized by:

said upper frame portion comprising a front and a rear member connected by end members, and said lift means comprising a pair of tube sections attached one each to said upper frame portion end members, said tube sections having passageways to receive tongs a forklift-type truck.

3. A device as defined by claim 1 and further characterized by:

said lift means comprising pairs of clips attached to said structure with said clips prepared for connection to a sling of a crane, at least one each of said clip pairs positioned equidistant on each side of a center of said structure.

4. A device as defined by claim 1 and further characterized by:

said lower frame portion comprising by an elongated front and rear member connected by end members, and said bracket means comprising at least two retaining brackets attached to said lower frame portion members and extending downward therefrom, said brackets spaced apart a distance equal to a length of a standard scaffold section with each said bracket defined by spaced apart plates prepared to receive therebetween an upper cross piece of said scaffold end frame unit, and each said retaining bracket plate having an opening for a pin to hold said end frame unit cross piece between said plates.

5. A device as defined by claim 1 and further characterized by including:

a pivot connection joining said lower frame portion to said upper frame portion, locking means carried by said structure to selectively inhibit rotation of said lower frame portion with respect to said upper frame portion, and rotational guide means comprising a pair of arcuate shaped guide rails carried by said lower frame portion and a pair of slide brackets carried by said upper frame portion, each said slide bracket having an element respectively engaged with one said guide rail to promote alignment of said frame portions during rotational movement therebetween.

6. A scaffold erection structure comprising:

an upper frame portion having spaced apart tube sections prepared to receive lifting tongs of a forklift-type truck and having a pair of spaced apart slide brackets, and a lower frame portion pivotally carried by said upper frame portion, said lower frame portion having a pair of spaced apart, arcuate shaped guide rails operatively engaged respectively by said upper frame portion slide brackets, and sets of downward extending retaining brackets comprising two pairs of end brackets attached one each to each end of said lower frame portion, a pair of middle brackets attached to said lower frame portion in substantial alignment with said pivot connection, and two pairs of intermediate brackets attached one each equidistant on each side of said middle brackets, said end brackets and middle brackets positioned to allow erection of two standard length scaffold sections, and said intermediate brackets positioned to allow erection of one standard length scaffold section, said sections upon erection being substantially balanced with respect to said pivot connection.

7. A method of erecting scaffolding comprising the steps of:

a. lifting an erection structure with external power means a distance slightly greater than a height of a standard scaffold end frame unit, b. securing upper ends of at least two said end frame units in bracket means carried by said structure to space said units apart a distance substantially equal to a length of a standard section of said scaffolding, and c. connecting said end frame units with cross bracing to form said scaffold section.

8. A method as defined by claim 7 and further characterized by:

said external power means being a forklift-type truck having lifting tongs insertable in spaced tube sections carried by said structure.

9. A method as defined by claim 7 and further characterized by:

said external power means being a crane having a sling attachable to clips carried by said structure.

10. A method as defined by claim 7 and further characterized by including the steps of:

d. lifting said erection structure for a second time with said external power means a distance substantially equal to said first lift distance, and e. attaching another section of scaffold to bottom ends of said first scaffold section to create first and second tier of scaffolding.

11. A method as defined by claim 7 and further characterized by including the step of:

d. moving said completed scaffold section with said external power means from a place of erection to a place of use.

12. A method as defined by claim 11 and further characterized by including the steps of:

e. maintaining a position of said scaffold section substantially perpendicular to a path of said movement until said scaffold section approaches said place of use, and f. rotating a lower frame portion of said structure at said approach point as required to place said scaffold section in a more useful position at said place of use.

* * * * *